US012337249B2

(12) United States Patent
Parr et al.

(10) Patent No.: US 12,337,249 B2
(45) Date of Patent: Jun. 24, 2025

(54) SYSTEMS AND METHODS FOR A MULTI-DEGREE OF FREEDOM RIDE VEHICLE

(71) Applicant: Universal City Studios LLC, Universal City, CA (US)

(72) Inventors: Eric Rae Parr, Orlando, FL (US); Keith Michael McVeen, Winter Garden, FL (US); Thierry Jean Andre Coup, Winter Garden, FL (US); Sarah Anne Kelley, Orlando, FL (US); Eric Allan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 966 days.

(21) Appl. No.: 17/394,694

(22) Filed: Aug. 5, 2021

(65) Prior Publication Data

US 2023/0009457 A1 Jan. 12, 2023

Related U.S. Application Data

(60) Provisional application No. 63/218,657, filed on Jul. 6, 2021.

(51) Int. Cl.
*A63G 7/00* (2006.01)
*B61L 25/02* (2006.01)

(52) U.S. Cl.
CPC ..... *A63G 7/00* (2013.01); *B61L 25/021* (2013.01); *B61L 25/025* (2013.01)

(58) Field of Classification Search
CPC ..... A63G 7/00; B61L 25/021; B61L 25/025; B61L 27/04
See application file for complete search history.

(56) References Cited

U.S. PATENT DOCUMENTS 5,403,238 A 4/1995 Baxter et al.
5,527,221 A 6/1996 Brown et al.
(Continued)

FOREIGN PATENT DOCUMENTS

EP 1289616 B1 11/2004
EP 20010938384 B1 11/2004
WO WO-9956846 A1 * 11/1999 ..... A63G 31/16

OTHER PUBLICATIONS

Tadokoro et al.; "A Motion Base With 6-DOF by Parallel Cable Drive Architecture", IEEE/ASME Transactions on Mechatronics Jun. 2002, Mar. 10, 2021, 9 pages, vol. 7, No. 2.
(Continued)

*Primary Examiner* — Robert J McCarry, Jr.
(74) *Attorney, Agent, or Firm* — Fletcher Yoder, PC

(57) ABSTRACT

A ride system includes a ride vehicle and an external sensor assembly disposed along a ride path and configured to measure external parameters. The ride vehicle includes an internal sensor assembly configured to measure internal parameters, a chassis, a cabin, and a motion base disposed between the chassis and the cabin, such that the motion base includes a turntable and a plurality of actuators. The ride vehicle also includes a controller that instructs (i) the turntable to rotate and (ii) the plurality of actuators to rotate, extend, or retract, to control six or more degree-of-freedom (DOF) motion of the cabin relative to the chassis, such that the controller is configured to instruct the turntable and the plurality of actuators based on the external parameters, the internal parameters, or both.

20 Claims, 5 Drawing Sheets

(56) References Cited

U.S. PATENT DOCUMENTS

| | | | | |
|---|---|---|---|---|
| 5,583,844 | A | 12/1996 | Wolf et al. | |
| 5,813,350 | A * | 9/1998 | Ochi | A63G 31/16 104/54 |
| 6,095,926 | A | 8/2000 | Hettema et al. | |
| 6,179,619 | B1 | 1/2001 | Tanaka | |
| 8,641,540 | B2 | 2/2014 | Feuer et al. | |
| 9,084,941 | B1 | 7/2015 | Fram | |
| 9,120,021 | B2 | 9/2015 | Crawford et al. | |
| 9,162,150 | B2 | 10/2015 | Roodenburg et al. | |
| 9,751,022 | B1 | 9/2017 | Fram | |
| 10,413,836 | B2 | 9/2019 | Blum et al. | |
| 2014/0358330 | A1 | 12/2014 | De-Gol | |
| 2017/0345198 | A1 | 11/2017 | Magpuri et al. | |
| 2019/0354282 | A1 | 11/2019 | Hall et al. | |

OTHER PUBLICATIONS

PCT/US2019/020407 International Search Report and Written Opinion, dated May 27, 2019.

Kuka, "Rent a certified 6-axis robot as a safe amusement ride: a lot of action with little effort", Kuka Coaster, Aug. 3, 2021, 6 Pages, Shelby Township.

PCT/US2022/034280 International Search Report and Written Opinion mailed Oct. 7, 2022.

* cited by examiner

SYSTEMS AND METHODS FOR A MULTI-DEGREE OF FREEDOM RIDE VEHICLE

CROSS REFERENCE TO RELATED APPLICATIONS

This application claims priority from and the benefit of U.S. Provisional Application Ser. No. 63/218,657, entitled "SYSTEMS AND METHODS FOR A MULTI-DEGREE OF FREEDOM RIDE VEHICLE", filed Jul. 6, 2021, which is hereby incorporated by reference in its entirety for all purposes.

BACKGROUND

The present disclosure relates generally to amusement park-style rides, and more specifically to systems and methods for ride vehicle motion control in amusement park-style rides via a multi-degree-of-freedom (DOF) motion base system.

Amusement park-style rides may include ride vehicles that carry passengers along a ride path, for example, defined by a track. Over the course of the ride, the vehicle ride path may include a number of features, including tunnels, turns, ups, downs, loops, and so forth. The direction of travel of the ride vehicle may be defined by the vehicle ride path, as rollers of the ride vehicle may contact the tracks or other features defining the vehicle ride path. An amusement park-style ride may also include a motion base (e.g., a Stewart platform) that may cause movement of a ride vehicle or cabin in various directions (e.g., six or more degrees-of-freedom). A motion base may be employed with visual effects to increase immersion in the experience and enhance riders' perception of motion. Some amusement park-style rides may include a combination of ride path interactions and motion base interactions. It is now recognized that improvements to ride system interaction systems and methods are desirable to provide better and more immersive ride experiences.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a ride vehicle includes a chassis, a cabin, and a motion base disposed between the chassis and the cabin and configured to control six or more degree-of-freedom (DOF) motion of the cabin relative to the chassis. The motion base includes a turntable configured to rotate and a plurality of actuators configured to rotate, extend, or retract.

In an embodiment, a method to control six or more degrees-of-freedom (DOF) motion of a ride vehicle includes receiving, via a processor of a control system, sensor data from an internal sensor assembly and an external sensor assembly associated with the ride vehicle. The method includes determining, via the processor, internal parameters and external parameters of the ride vehicle based on the sensor data. The method includes instructing, via the processor, a motion base of the ride vehicle to actuate and control the six or more DOF motion of the ride vehicle as it travels along a ride path based on the internal parameters and the external parameters, wherein the motion base is disposed between a cabin of the ride vehicle and a chassis of the ride vehicle, and wherein the motion base comprises a turntable and a plurality of actuators.

In an embodiment, a ride system includes a ride vehicle and an external sensor assembly disposed along a ride path and configured to measure external parameters. The ride vehicle includes an internal sensor assembly configured to measure internal parameters, a chassis, a cabin, and a motion base disposed between the chassis and the cabin, such that the motion base includes a turntable and a plurality of actuators. The ride vehicle also includes a controller that instructs (i) the turntable to rotate and (ii) the plurality of actuators to rotate, extend, or retract, to control six or more degree-of-freedom (DOF) motion of the cabin relative to the chassis, such that the controller is configured to instruct the turntable and the plurality of actuators based on the external parameters, the internal parameters, or both.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
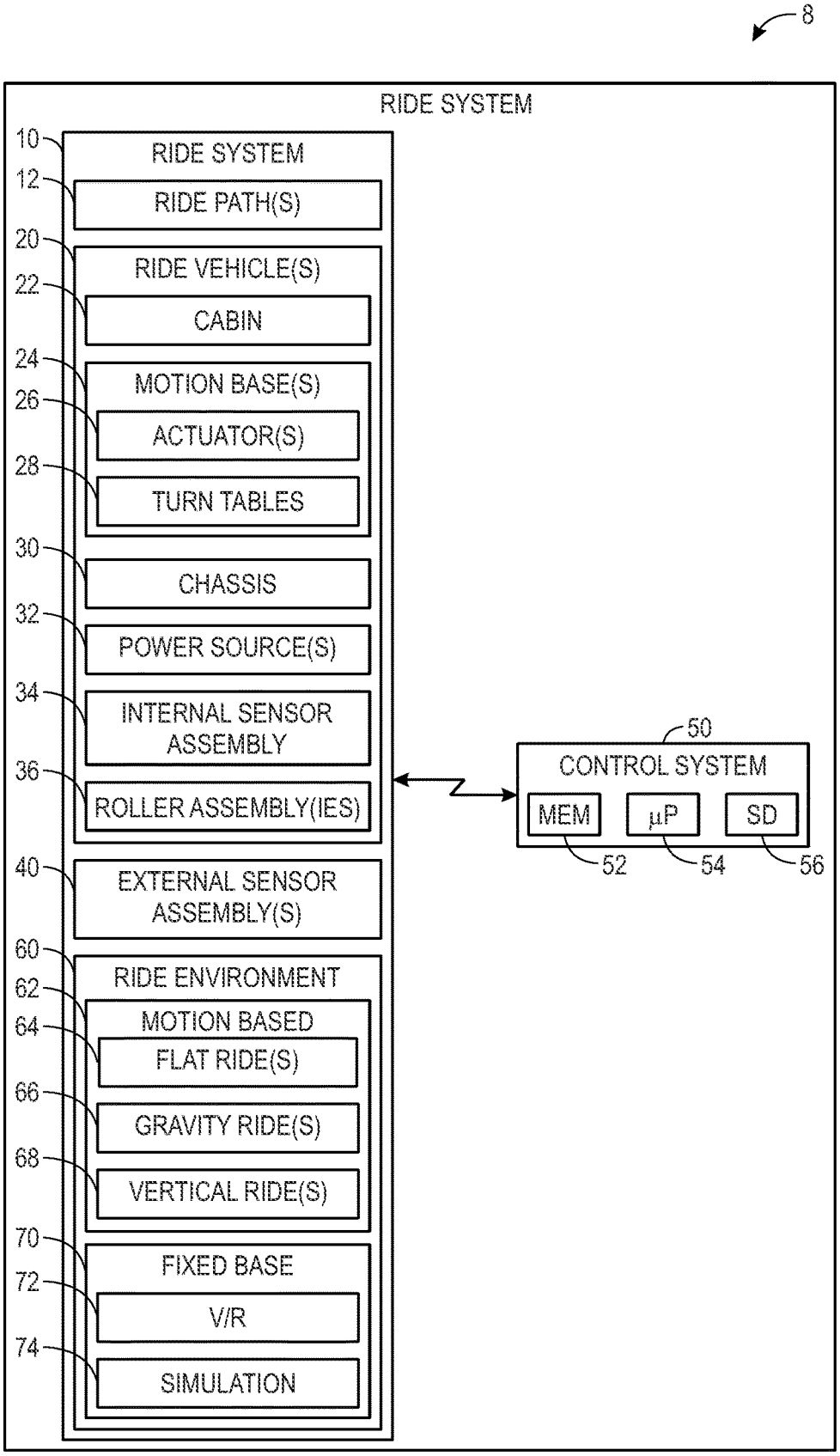
FIG. 1 is a block diagram of an embodiment of various components of an amusement park, in accordance with aspects of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

One or more specific embodiments of the present disclosure will be described below. In an effort to provide a concise description of these embodiments, all features of an actual implementation may not be described in the specification. To facilitate illustration, certain features are amplified or reduced in size, such that aspects of the illustrated embodiments may not be drawn to scale. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the following discussion is generally provided in the context of amusement park-style rides that may include a ride vehicle that includes a motion base configured to achieve six degrees-of-freedom (DOF) motion, it should be understood that the embodiments disclosed herein are not limited to such entertainment contexts. Indeed, the provision of examples and explanations in such an entertainment application is to facilitate explanation by providing instances of real-world implementations and applications. As such, it should be appreciated that the embodiments disclosed herein may be useful in other contexts, such as transportation systems (e.g., train systems, building and floor connecting systems), space exploration systems, and/or other industrial, commercial, and/or recreational human transportation systems, to name a few.

Amusement park-style rides may include a separate motion base that is separate from the ride vehicle. The separate motion base may move along a respective motion base ride path, which may intersect the vehicle ride path, or may be positioned at a fixed location along the ride path and operable to engage the ride vehicle. In these approaches, the ride vehicle may disconnect from the vehicle ride path, couple to the separate motion base, and then be transported via the separate motion base through a series of movements (e.g., pre-programmed movements) and/or along the motion base ride path.

While traveling on the vehicle ride path, passengers may be able to observe the separate motion base positioned along the ride path or traveling along the motion base ride path and thus are able to anticipate a change in motion (e.g., from the vehicle ride path to the motion base ride path), thereby reducing the overall thrill and excitement experienced by the passengers. Further, movements may be predictable for repeat riders. That is, approaches employing motion bases may be devoid of the thrill associated with unexpected motion that may defy the perception and expectations of passengers. Moreover, approaches employing separate tracks for the ride vehicle and the motion base may require a larger amusement park space to accommodate the additional track and features. Accordingly, while it may be desirable to employ a separate motion base in association with a ride vehicle, certain motion-based amusement park-style rides may fail to provide a level of thrill and excitement that defies the perception and anticipated motion of passengers.

With the forgoing in mind, present embodiments include systems and methods for controlling motion of a ride vehicle operating within a ride system. For example, ride systems, such as an amusement park-style ride, may include one or more ride vehicles that carry passengers along a ride path, for example, defined by a track. Over the course of the ride, the ride path may include a number of features, including tunnels, turns, ups, downs, loops, and so forth. The direction of travel of the ride vehicle may be defined by the ride path, for example, as rollers of the ride vehicle may be in constant contact with the tracks defining the ride path. The ride vehicle may also incorporate a motion base that travels along the ride path. It may be desirable to control ride vehicle motion along six degrees-of-freedom (DOF), using the motion base in conjunction with the ride path, based on "internal data" and "external data," for example, to enhance thrill along the ride path.

As used herein, "internal data" may refer to sensor data (e.g., real-time sensor data) that may be communicated to a control system and used to determine internal parameters (e.g., real-time internal parameters) associated with the ride vehicle. The internal sensor assembly may be mounted on or within the ride vehicle or may be mounted external to the ride vehicle. The internal sensor assembly may determine and/or measure internal parameters based on the internal data. Internal data may include sensor signals processed to determine a position, orientation, velocity (e.g., linear and/or rotational), acceleration (e.g., linear and/or rotational), jerk (e.g., linear and/or rotational), and/or other suitable internal parameters, associated with the ride vehicle.

As used herein, "external data" may refer to sensor data (e.g., real-time sensor data) that may be communicated to a control system and used to determine external parameters (e.g., real-time external parameters) associated with the ride vehicle. The external sensor assembly may be mounted external to the ride vehicle or may be mounted within or onboard the ride vehicle. The external sensor assembly may determine and/or measure external parameters based on the external data. The external data may include sensor signals processed to determine motion of a show element (e.g., an animated figure, an off board character, and the like), lighting parameters, speech parameters, wind parameters (e.g., velocity of wind), terrain texture, time stamp(s), and/or any suitable environmental parameters (e.g., humidity levels, rain conditions, air moisture, and so forth).

In either case, the internal data and/or the external data may change based on inputs (such that the inputs may be considered internal data) received from a passenger or based on a trajectory associated with a ride system in which the ride vehicle operates. For example, a ride vehicle may include an accelerator pedal that a passenger may depress to increase or decrease a speed of the ride vehicle. In this manner, a velocity (e.g., internal parameter) of the ride vehicle may change (e.g., based on internal data). As another example, a ride system may include a user input device, such as a plurality of targets (e.g., disposed along a ride path) that a user may engage (e.g., by way of a pointer device) to alter the lighting (e.g., external data) of the ride path. In this manner, lighting parameters (e.g., based on external data) associated with the ride vehicle may change. As used herein, "sensor data" may refer to both "internal data" and "external data."

A control system may receive the internal data and/or the external data to determine internal parameters and/or external parameters used to compute or determine a state of the ride system or ride vehicle. As used herein a "state" may refer to a set of variables that are used to describe a model (e.g., a mathematical model) indicative of a dynamical system. In the context of control systems, a state may be used to describe enough about a system (e.g., a cabin of the ride vehicle) to determine future behavior (e.g., physical positioning relative to time) in the absence of any external forces affecting the system. To that end, a control algorithm may be applied to a "current state" to achieve a future "target state." Example control algorithms include a proportional-integral-derivative (PID) controller, proportional-derivative (PD) controller, linear-quadratic regulator, and/or any other suitable control technique that may employ real-time (or near real-time) feedback loops to achieve target states.

In accordance with certain embodiments of systems and methods disclosed herein, the ride vehicle may include a motion base that moves with (e.g., is fixed to) the ride vehicle to achieve the six DOF motion discussed herein. Further, present embodiments may coordinate movement along the ride path and operation of the motion base to achieve desired motion profiles. For example, movement along the ride path may be accounted for in movement of the motion base to achieve results that are surprising or thrilling for passengers. Further, sensor data may also be taken into account for generating such motion profiles using the motion base in combination with the movement along the ride path.

In accordance with certain embodiments of systems and methods disclosed herein, the motion base may be positioned between a chassis of the ride vehicle and a cabin that houses or encloses (e.g., fully or partially encloses) one or more ride passengers of the ride vehicle. The motion base may include a turntable and/or actuators that are communicatively coupled to a control system that may instruct the turntable and/or the plurality of actuators to actuate based on the external parameters and/or the internal parameters. In this manner, a control system may instruct the turntable and/or the actuators to actuate, thereby controlling a positon, velocity, and/or acceleration of the cabin relative to the chassis along or about each of three orthogonal axis, as discussed below. Accordingly, actuation of the turntable and/or actuators may provide a wide range of control (e.g., along six DOF) of a cabin of a ride vehicle, for example, to reduce, eliminate, or enhance certain forces applied to a cabin housing ride passengers, thereby enhancing thrill by defying expectations of ride passengers.

To help illustrate, FIG. 1 is a block diagram of an embodiment of various components of an amusement park 8, in accordance with aspects of the present disclosure. The amusement park 8 may include a ride system 10, which may include a ride path 12 that receives and guides a ride vehicle 20, for example, by engaging with tires or rollers of the ride vehicle 20, and facilitates movement of the ride vehicle 20 (e.g., through an attraction). In this manner, the ride path 12 may define a trajectory and direction of travel that may include turns, inclines, declines, ups, downs, banks, loops, and the like. In an embodiment, the ride vehicle 20 may be passively driven or actively driven via a pneumatic system, a motor system, a tire drive system, a roller system, fins coupled to an electromagnetic drive system, a catapult system, and the like. For example, the ride vehicle 20 may include any suitable drive mechanisms and/or motion enabling features, such as actively-driven or passively-driven tires, tracks, or actuatable components. In an embodiment, the ride path 12 may include any suitable surface.

The ride path 12 may receive more than one ride vehicle 20. The ride vehicles 20 may be separate from one another, such that each ride vehicle 20 is independently controlled, as discussed below with respect to FIG. 5, or the ride vehicles 20 may be coupled to one another via any suitable linkage, such that motion of the ride vehicles 20 is coupled or linked. For example, the front portion of one ride vehicle 20 may be coupled to a rear portion of another ride vehicle 20. Each ride vehicle 20 in these and other configurations may hold one or more passengers, for example, in a cabin 22. The cabin 22 may partially or fully enclose or house one or more passengers.

The ride vehicle 20 may include a motion base 24, which may include one or more actuators 26, turntables 28, or any suitable experience-enhancing motion-based device configured to execute thrill-enhancing motion of the cabin 22 housing the passenger relative to a chassis 30 of the ride vehicle 20. In an embodiment, the motion base 24 is fixed to (e.g., non-removable from) the ride vehicle 20 during operation of the ride vehicle 20. The motion base 24 may be positioned between the cabin 22 and the chassis 30. For example, the actuators 26, the turntable 28, or both, of the motion base 24 may be rotatably or movably coupled to the chassis 30, the cabin 22, or both. In this manner, actuation of the actuators 26 and the turntable 28 may control six DOF of the cabin 22 relative to the chassis 30 or ride path 12 to provide a wider range of control than available using traditional ride vehicle devices. Thus, a state of the cabin 22 (e.g., the motion of the cabin 22 relative to the ride path 12) may be different than a state of the chassis 30 (e.g., the motion of the chassis 30 relative to the ride path 12). It should be understood that the motion base 24 may include any suitable motion enhancing feature, such as a haptic device configured to cause the cabin 22 to vibrate to any suitable frequency.

In an embodiment, the motion base 24 may be removable from the ride vehicle 20. For example, off board equipment may couple to the motion base 24 to remove the motion base 24 from ride vehicle 20. The off board equipment may be driven by tire drives, linear synchronization motors (LSMs), linear induction motors (LIMs), and the like, on a respective off board ride path separate from or the same as the ride path 12 to supply power to the off board equipment to transport the decoupled motion base 24 from the ride vehicle 20. In an embodiment, the motion base 24 may include a locking mechanism to couple and decouple to the ride vehicle 20. When the motion base 24 is decoupled from the ride vehicle 20, the cabin 22 may be fixed to the chassis 30.

The chassis 30 may support a power source 32, a motor, a pneumatic driving system, an electrical system, the cabin 22, and the like. The power source 32 may include any suitable powering device, such as a battery (e.g., 200 kWh battery), a bus bar slip device, a flywheel generator, ultracapacitors, or any combination thereof. In an embodiment, the power source 32 may include an inductive charge device (e.g., split transformer) that generates charge through an air gap.

The chassis 30 may support the load of the various components of the ride vehicle 20 and the ride passengers. Furthermore, the chassis 30 may support the motion base 24 (e.g., the actuators 26 and the turntable 28), which may be positioned between the chassis 30 and the cabin 22. In an embodiment, the turntable 28 may be rigidly coupled to the cabin 22, such that rotation of the turntable 28, in response to control instructions, results in a similar rotation of the cabin 22 relative to the chassis 30 to further enhance the ride experience. For example, the turntable 28 may allow the cabin 22 to rotate relative to the chassis 30 about a yaw axis, as discussed below.

The chassis 30 may support the actuators 26, which may be positioned between the chassis 30 and the cabin 22. In an embodiment, the actuators 26 may be integral to (e.g., positioned and fixed onto) the turntable 28. For example, a first end of the actuators 26 may couple to the turntable 28, while a second end of the actuators may couple to (e.g., an underside of) the cabin 22. The actuators 26 may allow the cabin 22 to rotate about or translate/displace along a roll axis, a pitch axis, and/or a yaw axis, in accordance with the control instructions, as discussed below. For example, the actuators 26 may include linear actuators, rotary actuators, hydraulic actuators, pneumatic actuators, electric actuators, thermal and/or magnetic actuators, supercoiled polymer actuators, or any suitable devices configured to displace to control motion (e.g., of the cabin 22 relative to the chassis 30 or ride path 12). Furthermore, the motion base 24 may enable the cabin 22 to move relative to the chassis 30 in any suitable direction. To this end, the motion base 24 may enable the cabin 22 to rotate about or vibrate along a yaw axis, a pitch axis, or a roll axis. In this manner, the motion base 24 may enable six DOF motion of the cabin 22 relative to the chassis 30.

Furthermore, the ride vehicle 20 may include one or more internal sensor assemblies 34 configured to determine and/or measure internal data to determine internal parameters of the ride vehicle 20. The internal sensor assembly 34 may be positioned and fixed on board the ride vehicle 20 or may be positioned external to the ride vehicle 20. The internal sensor assembly 34 may be communicatively coupled to a control system, as discussed in detail below. The internal data may include data (e.g., sensor signals) indicative of a position, orientation, velocity (e.g., linear and/or rotational), acceleration (e.g., linear and/or rotational), jerk (e.g., linear and/or rotational), and so forth, associated with the ride vehicle 20.

For example, the internal sensor assembly 34 may include an infrared sensor or any suitable sensor used to determine a position, velocity, and acceleration of the ride vehicle 20 along or about the roll axis, the pitch axis, or the yaw axis, as discussed below. The sensor assembly 34 may include an orientation sensor, such as a gyroscope and/or accelerometer, configured to provide feedback for use in determining motion of any portion of the ride vehicle 20 (e.g., the cabin 22), such as linear motion along and rotation motion about three orthogonal axes of the ride vehicle 20.

The ride vehicle 20 may include roller assemblies 36, which may include one or more rollers that engage with the tracks defining the ride path 12. For example, the roller assemblies 36 may include running rollers or actively-driven rollers to drive and/or guide motion of the ride vehicle 20 along the ride path 12, up-stop rollers that couple to the underside of the tracks, side friction rollers that couple to the side of the tracks, or any combination thereof.

Furthermore, the ride system 10 may include one or more external sensor assemblies 40 configured to determine and/or measure external data to determine external parameters of the ride vehicle 20. Although illustrated external to the ride vehicle 20 in FIG. 1, in an embodiment, the external sensor assembly 40 may be positioned and fixed onboard the ride vehicle 20. In an embodiment, the external sensor assembly 40 may be positioned external to the ride vehicle 20. The external sensor assembly 40 may be communicatively coupled to a control system, as discussed in detail below. The external data may include an indication of motion of a show element (e.g., an animated figure, an off board character, and the like), lighting parameters, speech parameters, environmental parameters (e.g., humidity levels, rain conditions, air moisture, and so forth), wind parameters (e.g., velocity of wind), terrain texture, a time stamp, and so forth.

For example, the external sensor assembly 40 may include any suitable sensor to determine the external parameters and/or determine any inputs from a passenger or ride system personnel. The external sensor assembly 40 may include a light sensor configured to measure and/or determine any suitable lighting properties (e.g., brightness, grayscale, hue, and light energy). The external sensor assembly 40 may include a microphone or other sound detection device to measure and/or determine speech patterns or sounds. The external sensor assembly 40 may include haptic sensors configured to measure vibrations or pressures, for example, associated with a terrain on which a ride vehicle 20 may operate. The external sensor assembly 40 may include a timing device to measure and/or determine a timing or duration of the operation of the ride vehicle 20 (e.g., measured from start to finish of the operation of the ride vehicle).

The amusement park 8 may include a control system 50 that is communicatively coupled (e.g., via wired or wireless features, such as transceivers) to the ride vehicle 20, the internal sensor assembly 34, the external sensor assembly 40, and/or the features associated with the ride system 10. In an embodiment, the amusement park 8 may include more than one control system 50. For example, the amusement park 8 may include one control system 50 associated with the ride vehicle 20, another control system 50 associated with the ride path 12, a base station control system 50, and the like. Further, the control systems 50 may be communicatively coupled to one another (e.g., via respective transceiver or wired connections). In an embodiment, the control system 50 may be part of (e.g., physically located on or within) the ride system 10 or specific aspects of the ride system 10 (e.g., the ride vehicle 20).

The control system 50 may control various aspects of the amusement park 8. For example, in some portions of the ride path 12, the control system 50 may control or adjust the direction of travel, velocity, and acceleration of the ride vehicle 20. The control system 50 may receive sensor data (e.g., from the internal sensor assembly 34 and the external sensor assembly 40) to determine internal parameters and external parameters used to determine a current state of the ride vehicle 20. The control system may apply a control algorithm (e.g., as described with respect to FIG. 5) to components of the ride vehicle 20 and ride system 10 to achieve a target state of the cabin 22 and/or ride vehicle 20. For example, the control system 50 may apply a control algorithm and send respective control signals (e.g., instructions) to the actuators 26 and/or the turntable 28 to actuate the motion base 24 based on the internal parameters, the external parameters, or both to achieve a target state of the ride vehicle 20 (e.g., different from the current state of the ride vehicle 20).

The control system 50 may include memory circuitry 52 and processing circuitry 54, such as a microprocessor. The control system 50 may also include one or more storage devices 56 and/or other suitable components. The processing circuitry 54 may be used to execute software, such as software stored on the memory circuitry 52, to control the ride vehicle(s) 20 and any components associated with the ride vehicle 20 (e.g., the cabin 22, the motion base 24, the actuators 26, and/or the turntable 28). Moreover, the processing circuitry 54 may include multiple microprocessors, one or more "general-purpose" microprocessors, one or more special-purpose microprocessors, and/or one or more application-specific integrated circuits (ASICs), or some combination thereof. For example, the processing circuitry 54 may include one or more reduced instruction set (RISC) processors.

The memory circuitry 52 may include a volatile memory, such as random-access memory (RAM), and/or a nonvolatile memory, such as read-only memory (ROM). The memory circuitry 52 may store a variety of information and may be used for various purposes. For example, the memory circuitry 52 may store processor-executable instructions (e.g., firmware or software) for the processing circuitry 54 to execute, such as instructions for controlling components of the ride system 10. The instructions, when executed by the processing circuitry 54, may cause the processing circuitry 54 to control motion of the cabin 22 by actuating the actuators 26, the turntable 28, or any suitable component to drive motion of the cabin 22 relative to the chassis 30 to subject the passengers to thrill-enhancing motions that may further enhance the overall ride experience by subjecting the passenger to unexpected forces or reducing forces expected by the passengers. For example, the instructions may cause the processing circuitry 54 to instruct the actuators 26 to displace and/or accelerate a point on the cabin when the ride vehicle conducts a turn to reduce or eliminate gravitational forces (G-forces) associated with conducting the turn.

The storage device(s) 56 (e.g., nonvolatile storage) may include ROM, flash memory, a hard drive, or any other suitable optical, magnetic, or solid-state storage medium, or a combination thereof. The storage device(s) 56 may store ride system data (e.g., passenger information, data associated with the amusement park 8, data associated with a ride path trajectory), instructions (e.g., software or firmware for controlling the cabin 22, the motion base 24, the actuators 26, the turntable 28, and/or the ride vehicle 20), and/or any other suitable information.

The ride system 10 may additionally or alternatively include a ride environment 60, which may include multiple and differing combinations of environments. The ride environment 60 may correspond to the type of ride (e.g., dark ride, water coaster, roller coaster, virtual reality [V/R] experience, or any combination thereof) and/or associated characteristics (e.g., theming) of the type of ride. For example, the ride environment 60 may include aspects of the ride system 10 that add to the overall theming and/or experience associated with the ride system 10. The internal sensor assembly 34 and/or the external sensor assembly 40 may measure and communicate to the control system 50 internal and/or external parameters associated with the ride environment 60.

The ride system 10 may additionally or alternatively include a motion-based environment 62, in which the passengers are transported or moved by the ride system 10. For example, the motion-based environment 62 may include a flat ride 64 (e.g., a ride that moves passengers substantially within a plane that is generally aligned with the ground, such as by the ride vehicle 20 traveling along the ride path 12). In an embodiment, the flat ride 64 may include turns, the effects of which may be distorted by the motion base 24, for example, by reducing or enhancing the G-forces the cabin 22 may be subject to by the ride vehicle 20 turning. Additionally or alternatively, the motion-based environment 62 may include a gravity ride 66 (e.g., a ride system where motion of the ride vehicle 20 has at least a component along the gravity vector, such as when the ride vehicle 20 rides up a hilled path or down a hilled path). Additionally or alternatively, the motion-based environment 62 may include a vertical ride 68 (e.g., a ride that displaces passengers in a vertical plane).

The ride system 10 may additionally or alternatively include what may be referred to as a fixed base environment 70 or motionless environment, in which the passengers are not substantially transported or displaced by the ride system 10. In this case, the term "motionless" refers to a substantial lack of motion and not necessarily a complete absence of motion. For example, the fixed base environment 70 may include a virtual reality (V/R) feature 72 (e.g., the passenger may sit in a seat in the cabin 22 that vibrates based on control signals received by the actuators 26 or turntable 28, or remains stationary while wearing a virtual reality (V/R) headset displaying a V/R environment or experience) and/or a different kind of simulation 74. In an embodiment, the ride vehicle 20 may come to a stop along the ride path 12, such that the ride experience may include aspects of the fixed base environment 70 for a portion of the duration of the ride experience. While the fixed base environment 70 may not substantially displace the passenger, V/R and/or simulation effects may modify the perception of the passenger, which may be enhanced and contrasted by motion-based distortion provided by the motion base 24. To that end, it should be understood the ride system 10 may include both motion-based and fixed base environments 62 and 70, which make the motion base 24 a desirable feature, at least for enhancing the ride experience by enabling six DOF control of a structure (e.g., cabin 22) partially or fully enclosing a ride passenger.

Figure 2:
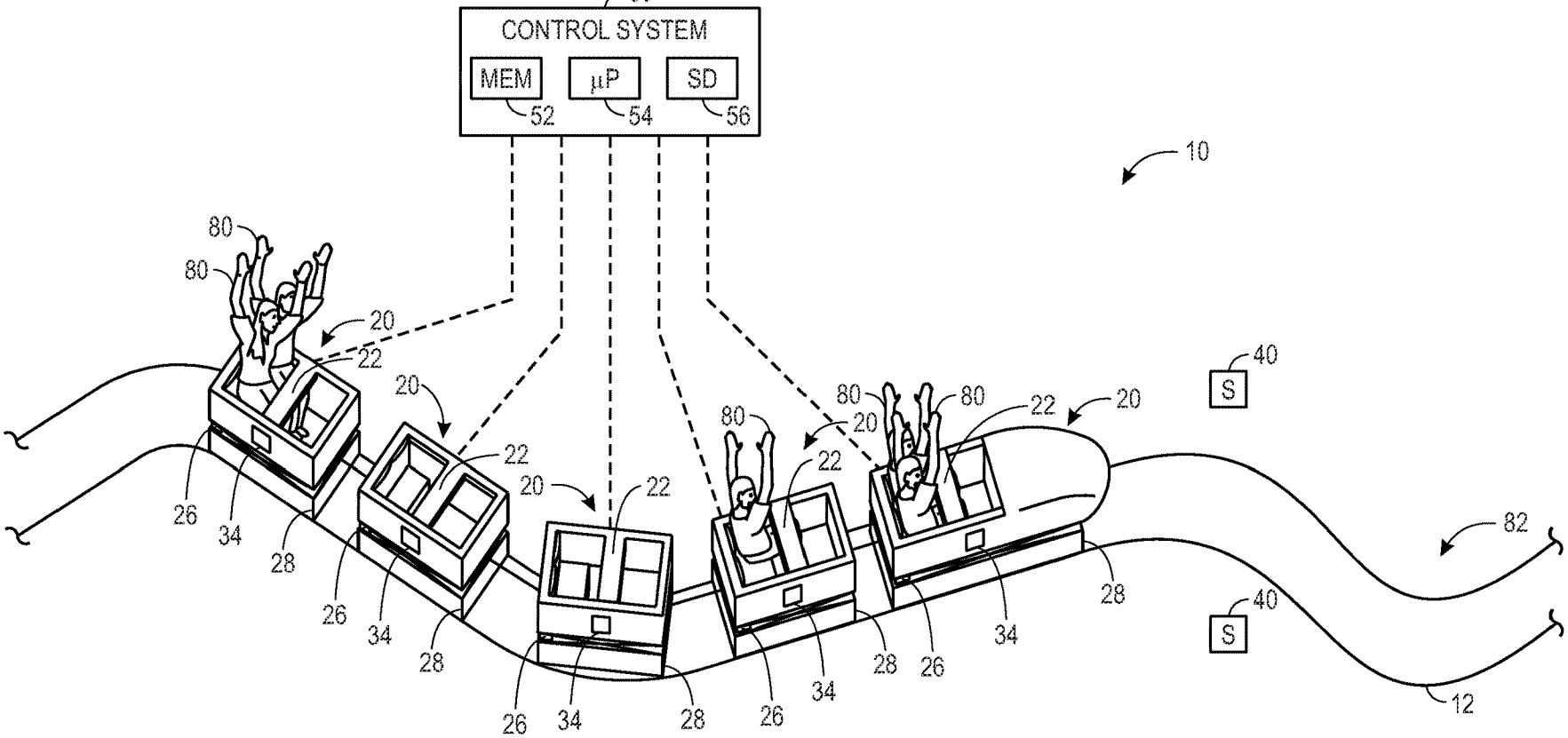
FIG. 2 is a schematic diagram of an embodiment of a ride system operating in the amusement park of FIG. 1, in accordance with aspects of the present disclosure.

FIG. 2 is a schematic diagram of an embodiment of the ride system 10, in accordance with aspects of the present disclosure. The ride system 10 may include multiple ride vehicles 20 coupled together via a linkage to join passengers 80 riding in corresponding ride vehicles 20 in a common ride experience. In an embodiment, the ride vehicles 20 may be decoupled from one another, and may move independently of one another instead of together, for example, along respective and/or separate ride paths 12. In another embodiment, the ride vehicles 20 may move as sets. The ride vehicles 20 may each include a motion base 24 that includes the actuators 26 and the turntable 28.

The control system 50 may receive sensor data (e.g., internal data from the internal sensor assembly 34 and external data from the external sensor assembly 40) to determine internal parameters and/or external parameters based on the sensor data. The control system may determine a target state of the ride vehicle 20. Based on the internal and/or external parameters, the control system 50 may instruct the actuators 26 and the turntable 28 to actuate to cause the cabin to achieve a target state. In one embodiment, the ride path 12 may include one or more turns 82, such that the ride vehicle 20 conducting the turn would typically result in a centripetal force (e.g., G-forces) being exerted on the cabin 22. The initiation of the turn may be detected by the control system 50 (e.g., by way of sensor data from the sensor assemblies 34, 40), which may instruct the turntable 28 and actuators 26 to actuate in such a manner that the centripetal force associated with executing the turn is eliminated, for example, by an opposite force of an equal magnitude on the cabin 22. Similarly, forces associated with other ride vehicle trajectories, such as rising up hilled tracks, lowering from hilled tracks, vibrations associated with bumpy tracks, and so forth, may be reduced or enhanced by way of the control system 50 instructing the motion base 24, the actuators 26, the turntable 28, or any other component of the ride vehicle 20 or ride system 10 to accelerate in such a manner that an opposite force of equal magnitude is applied to the cabin 22. Thus, present embodiments may allow users (e.g., the passengers 80) to define aspects of the ride experience (e.g., intense or mild movement) while utilizing the same fixed ride path 12 as different users that have a different ride experience. In an embodiment, users may dynamically change the nature of the ride experience during the ride experience. For example, if G-forces seem too high, a passenger may request lower G-forces (e.g., by way of interacting with any suitable user input device, such as a screen, a button, microphone, and the like) while on the ride and continuing along the same fixed ride path 12.

Figure 3:
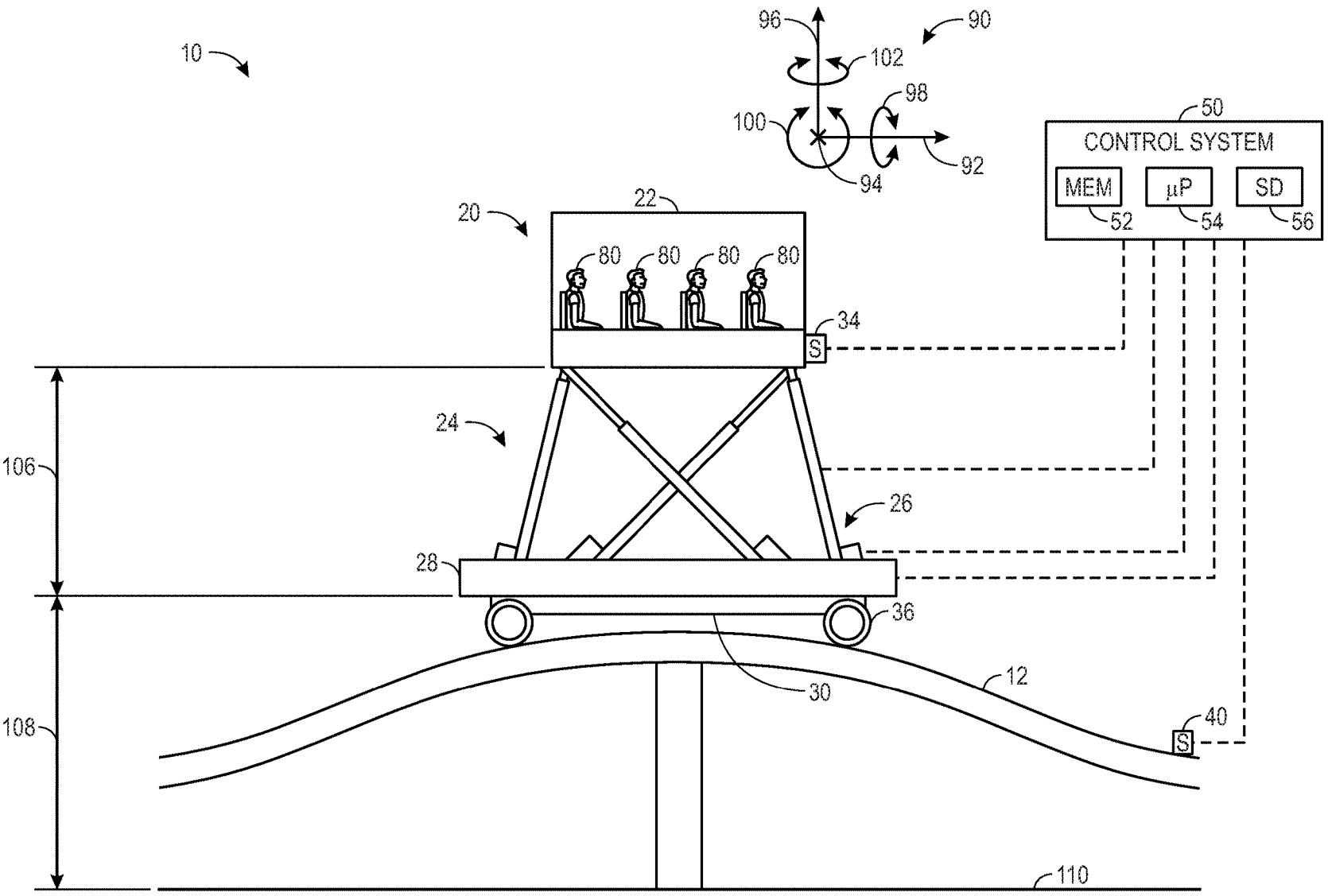
FIG. 3 is a schematic diagram of an embodiment of a ride vehicle operating in the ride system of FIG. 2, in accordance with aspects of the present disclosure.

FIG. 3 is a schematic diagram of an embodiment of a ride vehicle 20 operating in the ride system 10 of FIG. 2, in accordance with aspects of the present disclosure. To facilitate discussion, FIG. 3 includes a coordinate system 90 including a roll axis 92, a pitch axis 94, and a yaw axis 96, such that roll 98 may be defined as rotation about the roll axis 92, pitch 100 may be defined as rotation about the pitch axis 94, and yaw 102 may be defined as rotation about the yaw axis 96. The yaw axis 96 may be oriented along a gravity vector. The roll axis 92, the pitch axis 94, and the yaw axis 96 are orthogonal to one another.

In an embodiment, the ride vehicle 20 includes the cabin 22 supported by the chassis 30. The ride vehicle 20 may include a roller assembly 36 configured to contact the ride path 12 to control motion of the ride vehicle 20 along the ride path 12. As discussed above, the ride vehicle 20 may include a motion base 24 configured to control six DOF motion of the cabin 22 relative to the chassis 30. The motion base 24 may be positioned between the cabin 22 and the chassis 30. The motion base 24 may include the actuators 26 and the turntable 28, and be communicatively coupled to the control system 50.

The motion base 24 may include any suitable number of actuators 26 and or turntables 28. The motion base 24 may include six actuators 26 arranged as a hexapod, the motion base 24 may include eight actuators 26 arranged as an octapod, or the like. For example, as illustrated, the actuators 26 may be actuatably coupled to the underside of the cabin 22 and the top portion of the turntable 28 or the chassis 30. In an embodiment, the at least one actuator 26 may include a first end coupled to an end of the top portion of the turntable 28 or the chassis 30 and a second end coupled to an end of the underside of the cabin 22, such that the end of the top portion of the turntable 28 or the chassis 30 is opposite the end of the underside of the cabin 22.

The ride system 10 may include the internal sensor assembly 34 configured to determine and/or measure internal data indicative of internal parameters of the ride vehicle 20. The ride system 10 may include the external sensor assembly 40 configured to determine and/or measure external data indicative of external parameters of the ride vehicle 20. For example, the internal parameters of the ride vehicle 20 may include a cabin height 106 and a chassis height 108. As used herein, "cabin height" 106 may refer to a difference in distance between a target point (e.g., the top, the center of mass, and the like) on the chassis 30 relative to a target point (e.g., the bottom, the center of mass, and the like) on the cabin 22. As used herein, "chassis height" 108 may refer to a position of the chassis relative to a ground level 110. The control system 50 may be communicatively coupled to the internal sensor assembly 34 and the external sensor assembly 40. The control system 50 may control motion of the ride vehicle 20 and motion base 24 based at least on the cabin height 106 and/or the chassis height 108.

The actuators 26, the turntable 28, or both, of the motion base 24 may be rotatably or movably coupled to the chassis 30, the cabin 22, or both. In this manner, actuation of the actuators 26 and the turntable 28 may control six DOF of the cabin 22 relative to the chassis 30 to provide a wider range of control than available using traditional ride vehicles. For example, the control system 50 may instruct the actuators 26 to displace (e.g., vertically displace along the length of the actuator, rotate about a contact point, or both) to control motion of the cabin 22 relative to the chassis 30. For example, the control system 50 may cause the actuators 26 to be displaced such that the cabin 22 moves relative to the chassis 30 about or along the roll axis 92, the pitch axis 94, and/or the yaw axis 96. Actuation of the actuators 26 and/or the turntable 28 may be based on internal parameters such as the cabin height 106 and/or the chassis height 108 or external parameters such as a ride passenger's interaction with features along the ride path 12.

Figure 4:
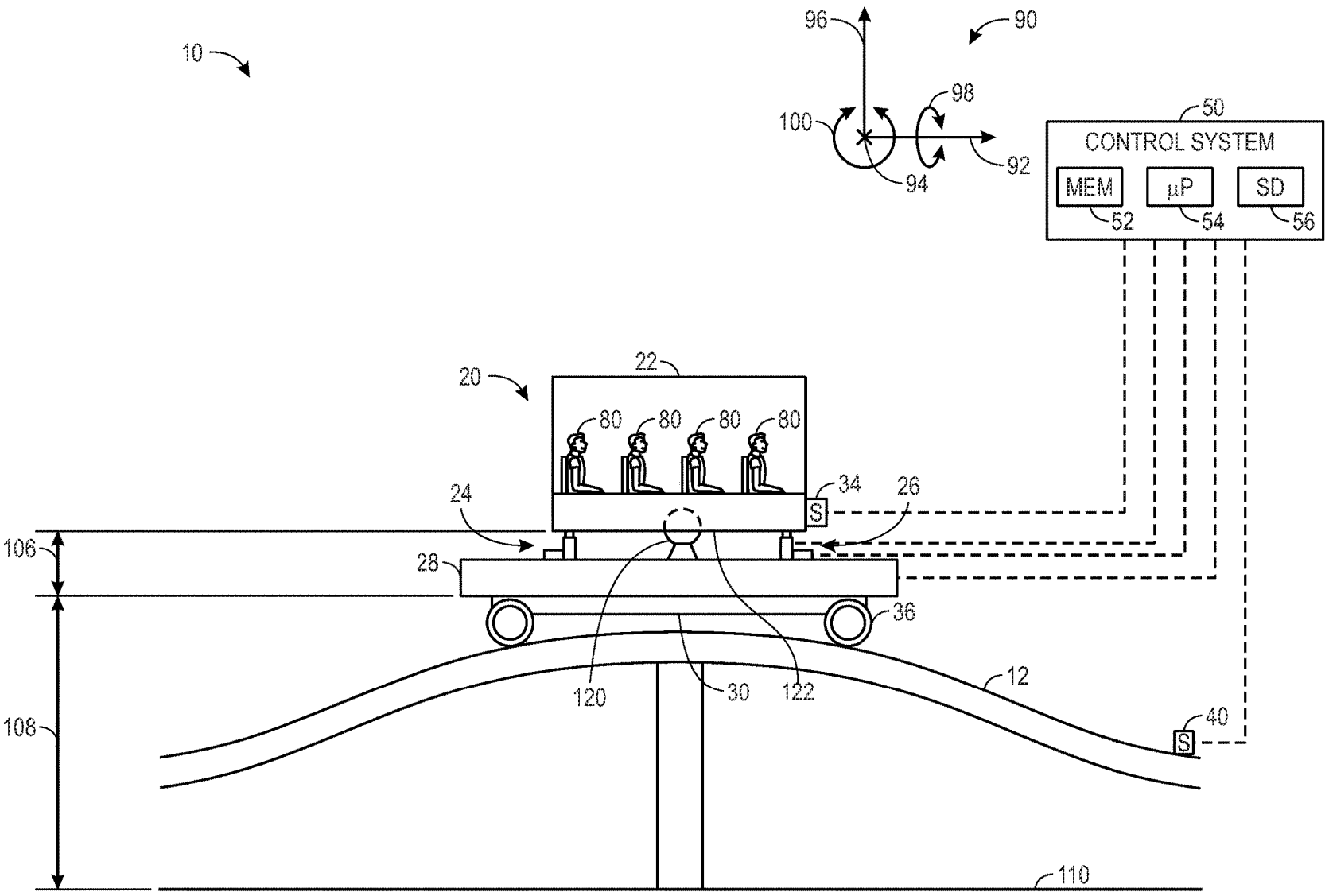
FIG. 4 is a schematic diagram of an embodiment of a ride vehicle operating in the ride system of FIG. 2, in accordance with aspects of the present disclosure.

FIG. 4 is a schematic diagram of an embodiment of a ride vehicle 20 operating in the ride system 10 of FIG. 2, in accordance with aspects of the present disclosure. The embodiment illustrated in FIG. 4 differs from the embodiment in FIG. 3 in that the ride vehicle 20 of FIG. 4 includes vertically oriented actuators 26, for example, which may be positioned at or near the corners of the cabin 22. In addition, FIG. 4 includes a stabilizing member 120, such as a ball-joint, that couples a central portion 122 of the cabin 22 to the chassis 30. The central portion 122 may be positioned on an underside (i.e., the side of the cabin 22 facing the ride path 12 and/or the chassis 30) of the cabin 22, such that the stabilizing member 120 may couple the chassis 30 to a central portion 122 on the underside of the cabin 22. In the context of the stabilizing member 120 being a ball-joint, the ball-joint may reduce the stress exerted on the vertically oriented actuators 26.

In an embodiment, the stabilizing member 120 is rotatably coupled to the cabin 22 (e.g., central portion 122) and rigidly coupled to the chassis 30, such that the control system 50 may instruct the actuators 26 to control motion of the cabin 22 relative to the chassis 30 along or about the roll axis 92, and/or along or about the pitch axis 94. In an embodiment, yaw rotation 102 (FIG. 3) about the yaw axis 96 may be restricted based on the coupling between the cabin 22 and the chassis 30 by way of the stabilizing member 120. It should be understood that any suitable actuatable devices may be added or removed from the motion base 24 for any suitable design-based purpose. For example, in an embodiment, the turntable 28 may be omitted from the motion base 24, for example to save space and reduce the weight of the ride vehicle 20, such that yaw rotation 102 about the yaw axis 96 may be restricted. Accordingly, in an embodiment, control of the motion base 24 may be along less than 6 DOF.

Figure 5:
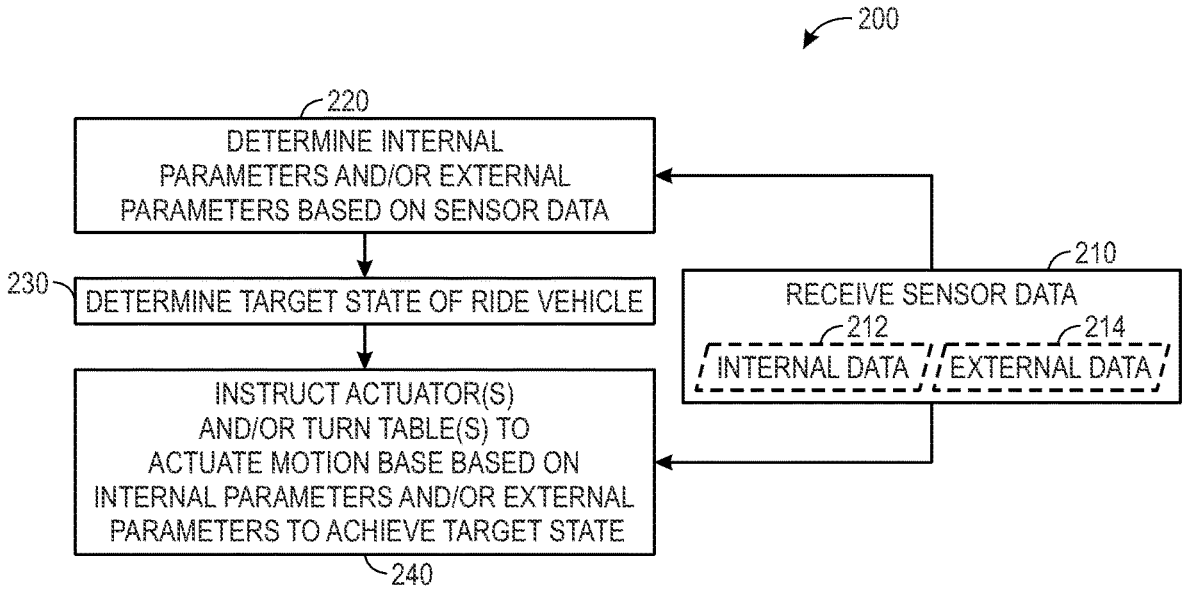
FIG. 5 is a flow diagram of a process for controlling a motion base on the ride vehicle of FIG. 3 or FIG. 4 operating in the ride system of FIG. 2, in accordance with aspects of the present disclosure.

FIG. 5 is flow diagram of a process 200 for controlling a ride vehicle 20 (FIGS. 1-4) and a motion base 24 (FIGS. 1-4) of the ride vehicle 20 operating in the ride system 10 (FIGS. 1-4), in accordance with aspects of the present disclosure. The process 200 may be implemented by the ride system 10. In a non-limiting embodiment, processor-based circuitry (e.g., the processor 54 of FIGS. 1-4) of the control system 50 (FIGS. 1-4) may facilitate implementing the process 200. In an embodiment, the process 200 may be implemented independently by each ride vehicle 20 of a plurality of ride vehicles 20. With the forgoing in mind, the control system 50 may receive (process block 210) sensor data, such as the internal data 212, the external data 214, or both, described above. The control system 50 may process the sensor data to (process block 220) determine internal parameters and/or external parameters based on the sensor data. The control system 50 may determine (process block 230) a target state of the ride vehicle 20. The control system 50 may instruct (process block 240) the actuators 26 (FIGS. 1-4) and/or the turntable 28 to actuate based on the internal parameters and/or the external parameters to achieve the target state.

As discussed above, the internal data 212 may be measured and/or determined by an internal sensor assembly 34 (FIGS. 1-4) that may be associated with the ride vehicle 20. The internal data 212 from the internal sensor assembly 34 may be processed by the control system 50 to determine (process block 220) internal parameters, such as position, orientation, velocity (e.g., linear and/or rotational), acceleration (e.g., linear and/or rotational), jerk (e.g., linear and/or rotational), and so forth, associated with the ride vehicle 20. For example, the internal parameters may include a position, orientation, velocity (e.g., linear and/or rotational), acceleration (e.g., linear and/or rotational), jerk (e.g., linear and/or rotational), and so forth, of any suitable portion (e.g., center of mass or center of gravity) of the cabin 22 or any feature of the ride vehicle 20. In an embodiment, the internal parameter may include a centripetal force associated with the ride vehicle 20 conducting a turn (e.g., along the ride path 12).

As discussed above, the external data 214 may be measured and/or determined by an external sensor assembly 40 (FIGS. 1-4) that may be associated with the ride vehicle 20. The external data 214 from the external sensor assembly 40 may be processed by the control system 50 to determine (process block 220) external parameters, such as motion of a show element, lighting parameters, speech parameters, wind parameters (e.g., velocity of wind), terrain texture, operation of external ride features, time parameters, environmental parameters (e.g., humidity levels, rain conditions, air moisture, and so forth), and so forth. For example, the ride path 12 (FIGS. 1-4) may include various ride features that a ride passenger 80 (FIGS. 2-4) may engage (e.g., by way of transceiver devices, haptic sensors, and so forth). Accordingly, the external data 214 may include an indication of whether the ride passenger 80 engaged with an external ride feature.

In an embodiment, the external sensor assembly 40 may include a timer configured to measure time associated with the ride system 10. For example, the external parameters may include a time stamp that the control system 50 may correlate to a position of the ride vehicle 20 at various features of the ride path 12, such as turns, inclines, and the like, during operation of the ride vehicle 20. In this manner, actuation of the motion base 24 may be correlated to a time stamp determined by the timer, for example, in a ride system 10 having a pre-set trajectory along a defined ride path 12.

Determining (process block 220) the internal parameters and/or external parameters may include determining a current state of the ride vehicle, such that the state of the vehicle includes a mathematical model describing the dynamics of the ride vehicle 20 and/or the cabin 22. The current state of the ride vehicle 20 may include the current measurements of the ride vehicle 20 for the variables associated with the mathematical model describing the dynamics of the ride vehicle 20 and/or the cabin 22. The current state may be associated with a particular time stamp (e.g., during which the current state was determined). The current state may also be based on measures from a gyroscope, accelerometer, speed sensor, G-force sensor, or the like.

Based on the current state, the internal parameters, and/or external parameters, the control system 50 may determine (process block 230) a target state of the ride vehicle 20 and/or cabin 22. For example, the control system 50 may determine (process block 230) that the ride vehicle 20 is traveling straight along the roll axis 92 (based on the internal parameters) and that the passenger has engaged with a particular external ride feature (based on external parameters). In response, the control system 50 may determine (process block 230) that the target state of the ride vehicle 20 is such that that cabin 22 should emulate a banked turn, mitigate G-forces, increase heave, or the like.

The control system 50 may instruct (process block 240) the actuators 26 and/or the turntable 28 to actuate based on the internal parameters and/or the external parameters to achieve the target state. The actuators 26 and/or the turntable 28 may actuate in or near real-time. In an embodiment, the actuation of the motion base is proportional to the internal parameters and the external parameters. Continuing the example of emulating a banked turn, the control system 50 may instruct (process block 240) the actuators 26 to extend or rotate (e.g., along or about the roll axis 92, along or about the pitch axis 94, and/or along the yaw axis 96) and/or instruct the turntable 28 to turn (e.g., in yaw 102 about the yaw axis 96) to reduce or enhance the centripetal force associated with the motion of the ride vehicle 20. In other situations, a different assembly of instructions may be provided to achieve a desired state or resulting motion profile.

In an embodiment, the ride vehicle 20 may include a haptic device, such that the control system 50 may instruct (process block 240) the haptic device to actuate the cabin 22 to a target frequency to generate target sounds or sensations. For example, the control system 50 may instruct the haptic device to actuate the cabin 22 to a frequency within an audible range (e.g., any frequency between 5 and 30 hertz (Hz)) to generate a buzzing sound. In an embodiment, the control system 50 may instruct (process block 240) the actuators 26 and/or the turntable 28 to actuate the cabin 22 to a frequency of above 30 Hz to generate a target sensation for ride passengers. For example, the control system 50 may instruct (process block 240) the motion base 24 to actuate the cabin 22 relative to the ride path 12 to generate a particular sound based on the frequency of the cabin 22.

The internal parameters may include an indication that the position of the ride vehicle 20 is approaching a certain portion of the ride path 12, such that the control system 50 may instruct (process block 240) the actuators 26 to actuate to cause the cabin to roll 98 about the roll axis 92 (among other directions of motion). In addition or alternatively, the external parameters may include an indication that the time stamp (i.e., the time that has elapsed since start of operation of the ride vehicle) is approaching a certain time, such that the control system may instruct (process block 240) the actuators 26 to actuate to cause the cabin to roll 98 about the roll axis 92 (among other directions of motions). In this manner, actuation of the motion base 24 may be based on a timer (e.g., timestamp), such that actuation of the motion base 24 may be pre-set.

Technical effects of the present disclosure include a ride vehicle including a motion base that includes actuators and a turntable to achieve multi-degree control, for example, along or about six DOF. The motion base may be fixed or removably coupled to the ride vehicle and be positioned between a cabin housing ride passengers and a chassis supporting various components of the ride vehicle. A control system may be communicatively coupled to features of the ride vehicle and configured to instruct the actuators and/or turntable to control motion of the cabin relative to the chassis to provide desired/target motion profiles or operational states, such as thrill enhancing motion or motion with reduced extremes. The control system may instruct the actuators and/or the turntable to displace the cabin relative to the chassis to simulate a banked turn despite the ride vehicle traveling straight. Similarly, the control system may instruct the actuators and/or the turntable to displace the cabin relative to the chassis to reduce G-forces applied to the cabin based on the ride vehicle executing a turn. In this manner, the G-forces experienced by the ride passengers may be unexpected and therefore thrill enhancing. Indeed, present embodiments take into account internal and/or external data to achieve desired ride experiences that can vary based on input between rides or ride vehicles while still traversing the same ride path.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride vehicle configured to travel on a multi-dimensional dynamically or gravity powered kinetic track, the ride vehicle comprising:
- a chassis;
- a cabin;
- an internal sensor assembly configured to determine real-time internal parameters of the ride vehicle;
- an external sensor assembly configured to determine real-time external parameters of the ride vehicle; and
- a motion base disposed between the chassis and the cabin and configured to control six or more degrees-of-freedom (DOF) motion of the cabin relative to the chassis, wherein the motion base comprises:
  - a turntable configured to rotate; and
  - a plurality of actuators configured to rotate, extend, or retract, wherein the six or more DOF motion of the cabin is controlled based on the real-time internal parameters, the real-time external parameters, or both.

2. The ride vehicle of claim 1, wherein the real-time external parameters comprise an indication of motion of a show element, wherein the six or more DOF of the cabin is controlled based on the indication of the motion of the show element.

3. The ride vehicle of claim 1, wherein the real-time internal parameters comprise a linear position, a linear velocity, a linear acceleration, a linear jerk, a rotational position, a rotational velocity, a rotational acceleration, a rotational jerk, or a combination thereof, of the ride vehicle.

4. The ride vehicle of claim 1, wherein the real-time external parameters comprise lighting parameters surrounding the cabin, a texture of a surface of a ride path, a time stamp, environmental parameters, or a combination thereof.

5. The ride vehicle of claim 1, comprising a control system that includes:
- a memory device storing instructions; and
- a processor communicatively coupled to the memory device and configured to execute the instructions to perform operations comprising:
  - receiving sensor data;
  - determining the real-time internal parameters and the real-time external parameters of the ride vehicle based on the sensor data; and
  - instructing the turntable, at least one actuator of the plurality of actuators, or both to actuate based on the real-time internal parameters and the real-time external parameters to control the six or more DOF motion.

6. The ride vehicle of claim 5, wherein determining the real-time internal parameters comprises determining a centripetal force associated with the ride vehicle conducting a turn along a ride path, wherein the turntable, the at least one actuator, or both are actuated to reduce or increase the centripetal force of the ride vehicle.

7. The ride vehicle of claim 5, wherein instructing the turntable, the at least one actuator, or both to actuate comprises instructing a haptic device or the motion base to vibrate the cabin to a frequency within an audible frequency range.

8. The ride vehicle of claim 1, comprising a user input device configured to receive a user input, wherein the control of the six or more DOF motion of the cabin relative to the chassis is based on the user input.

9. The ride vehicle of claim 1, wherein the plurality of actuators are disposed between the cabin and the turntable, wherein the turntable is positioned at an elevation lower than the cabin.

10. A method to control six or more degrees-of-freedom (DOF) motion of a ride vehicle, the method comprising:
- receiving, via a processor of a control system, sensor data from an internal sensor assembly and an external sensor assembly associated with the ride vehicle;
- determining, via the processor, internal parameters and external parameters of the ride vehicle based on the sensor data; and
- instructing, via the processor, a motion base of the ride vehicle to actuate and control the six or more DOF motion of the ride vehicle as it travels along a ride path based on the internal parameters and the external parameters, wherein the motion base is disposed between a cabin of the ride vehicle and a chassis of the ride vehicle, and wherein the motion base comprises a turntable and a plurality of actuators.

11. The method of claim 10, wherein the actuation of the motion base is proportional to the internal parameters and the external parameters.

12. The method of claim 10, wherein instructing the motion base to actuate comprises instructing, via the processor, the turntable to rotate and at least one actuator of the plurality of actuators to extend, retract, or rotate, or a combination thereof, in or near real-time.

13. The method of claim 10,
- wherein the internal parameters comprise:
  - a user input; and
  - a linear position, a linear velocity, a linear acceleration, a linear jerk, a rotational position, a rotational velocity, a rotational acceleration, a rotational jerk, or a combination thereof, of the ride vehicle, and
- wherein the external parameters comprise lighting parameters surrounding the cabin, a texture of a surface of the ride path, a time stamp, environmental parameters, or a combination thereof.

14. The method of claim 10, wherein determining the internal parameters comprises determining a centripetal force associated with the ride vehicle conducting a turn along the ride path, wherein the turntable, at least one actuator of the plurality of actuators, or both are actuated to reduce or increase the centripetal force associated the ride vehicle conducting the turn.

15. The method of claim 10, wherein instructing the motion base comprises instructing a haptic device to vibrate the cabin to a frequency within an audible range.

16. A ride system, comprising:

an external sensor assembly disposed along a ride path and configured to measure external parameters;

a ride vehicle, comprising:

an internal sensor assembly configured to measure internal parameters;

a chassis;

a cabin; and a motion base disposed between the chassis and the cabin, wherein the motion base comprises a turntable and a plurality of actuators; and a controller configured to instruct (i) the turntable to rotate and (ii) the plurality of actuators to rotate, extend, or retract, to control six or more degree-of-freedom (DOF) motion of the cabin relative to the chassis, wherein the controller is configured to instruct the turntable and the plurality of actuators based on the external parameters, the internal parameters, or both.

17. The ride system of claim 16, wherein:

the internal parameters comprise a linear position, a linear velocity, a linear acceleration, a linear jerk, a rotational position, a rotational velocity, a rotational acceleration, a rotational jerk, or a combination thereof, of the ride vehicle, and the external parameters comprise lighting parameters surrounding the cabin, a texture of a surface of the ride path, a time stamp, or a combination thereof.

18. The ride system of claim 16, wherein the motion base is fixed to the ride vehicle, such that the motion base is configured to move with the ride vehicle along the ride path.

19. The ride system of claim 16, wherein the controller instructing the turntable and the plurality of actuators comprises instructing a haptic device or the motion base to vibrate the cabin to a frequency within an audible frequency range.

20. The ride system of claim 16, wherein the turntable and at least one actuator of the plurality of actuators are configured to actuate in or near real-time based on the instructions from the controller.

* * * * *